United States Patent [19]

Sommer et al.

[11] Patent Number: 4,804,320

[45] Date of Patent: Feb. 14, 1989

[54] SLIDING SHUTTERING DEVICE

[75] Inventors: Arnold Sommer, Kaarst, Fed. Rep. of Germany; Richard Lienbacher, Golling, Austria

[73] Assignee: Gleitbau Gesellschaft Mit Beschränkter Haftung, Salzburg, Austria

[21] Appl. No.: 941,082

[22] Filed: Dec. 12, 1986

[51] Int. Cl.[4] ..... E04G 11/22

[52] U.S. Cl. ..... 425/65; 249/20; 249/26; 249/140; 249/152; 249/155; 249/182; 249/184; 264/32

[58] Field of Search ..... 249/13, 17, 20, 21, 249/22, 26, 98, 102, 104, 112, 152, 155, 157, 180, 181, 182, 184, 140; 425/63-65; 264/32-34

[56] References Cited

U.S. PATENT DOCUMENTS

| | | | |
|---|---|---|---|
| 2,705,359 | 4/1955 | Strandberg | 249/20 |
| 3,632,079 | 1/1972 | Rohlf | 249/20 |
| 4,128,610 | 12/1978 | Ahlgren | 249/20 |

FOREIGN PATENT DOCUMENTS

| | | | |
|---|---|---|---|
| 864146 | 1/1953 | Fed. Rep. of Germany | 425/63 |

*Primary Examiner*—Jay H. Woo
*Assistant Examiner*—James C. Housel
*Attorney, Agent, or Firm*—Fleit, Jacobson, Cohn & Price

[57] ABSTRACT

The invention relates to a sliding process for producing concrete structure walls and a sliding shuttering means for erecting or installing monolithic block brackets, praticularly in the case of annular structures. In order to permit a continuous installation of block brackets in the case of a favorable force transfer between the structure wall and the sliding shuttering, the invention provides for the integration into the sliding shuttering of shuttering forms which are substantially complimentary to the block brackets to be installed. In height regions without block brackets, the shuttering form is terminated in aligned manner on the wall side of the structure and is opened on reaching the height level of the block bracket to be installed. After providing the block bracket, on raising the sliding shuttering, the shuttering form is again closed at the top height level of the block bracket.

11 Claims, 7 Drawing Sheets

SLIDING SHUTTERING DEVICE

Figure 1:
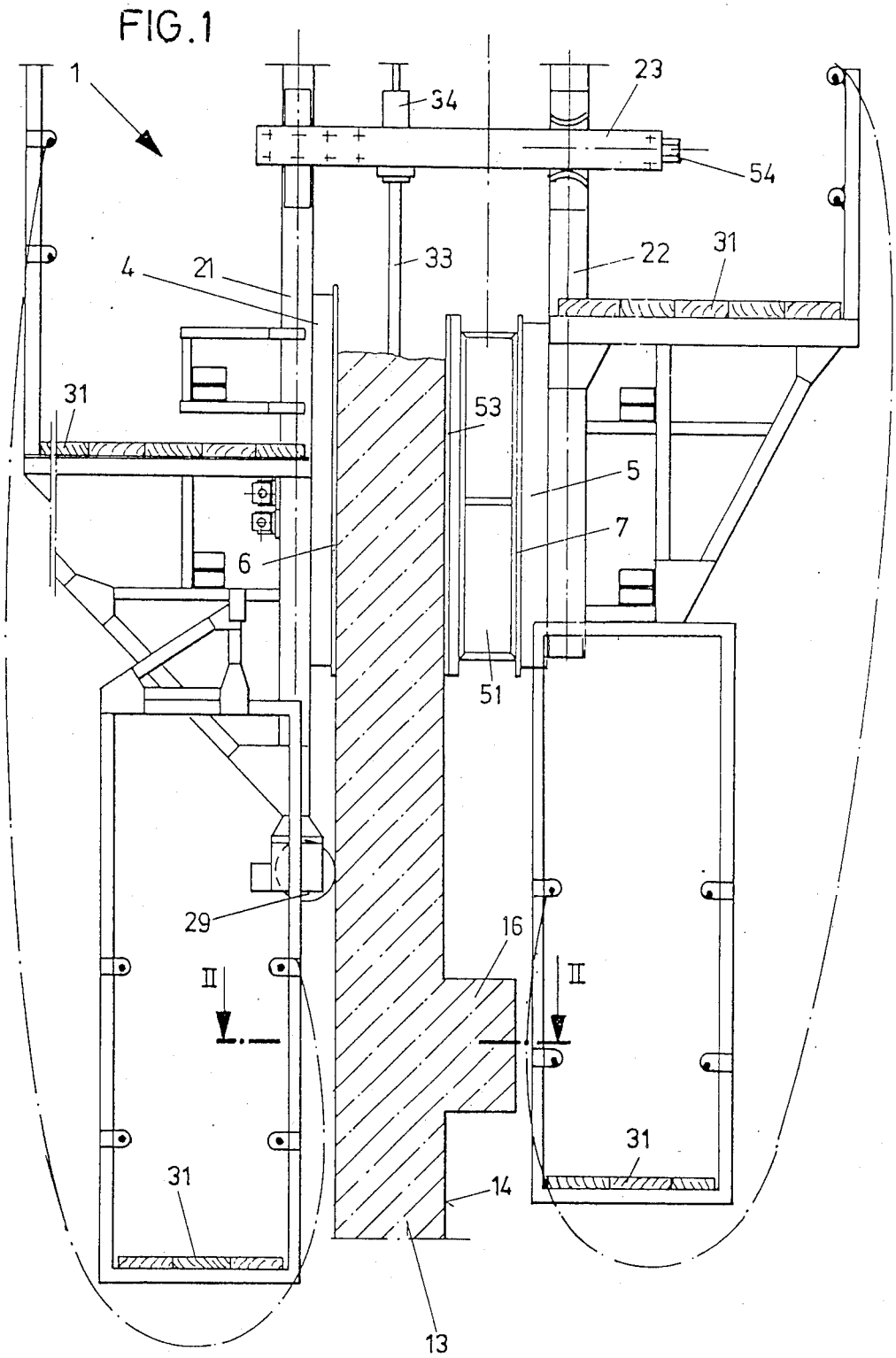

The invention relates to a sliding process for producing building or structure walls made from concrete or the like.

Comparable sliding processes and sliding shuttering means are admittedly known from Austrian Pat. No. 23 55 57 and DE-OS No. 29 47 210. However, this prior art relates to the erection of concrete structure walls which generally have a constant wall thickness, said prior art neither referring to nor permitting within the scope of the sliding process the production of a bracket or cantilever.

In the erection of reinforced concrete structures, such as television towers, chimneys or the like, it is conventional practice to produce individual brackets, linear or ring brackets projecting from the concrete wall subsequently in a single operation, following the erection of the actual structure wall in the sliding process. For this purpose during the sliding process for the structure walls, recesses are made at the corresponding points for the brackets and at the end of the sliding process and the dismantling of the sliding shuttering are set up and installed in a second operation. This means that the reinforcing rods necessary for the brackets must be bent sideways or upwards during the sliding process and then bent back again into the desired position for the same during the second operation. It is only then possible to shutter and concrete the brackets in their intended form.

Individual brackets, which will be referred to hereinafter as block brackets and which can have random cross-sectional configurations in cross-section, such as rectangular, trapezoidal or other polygonal forms have the advantage compared with ring or linear brackets that by means of a corresponding sliding process and suitable sliding shuttering means they can be installed precisely at the point where they are required. Compared with "triangular brackets", which in the vertical section of the structure wall initially have a continuous wall thickness increase and then undergo a stepped wall thickness decrease, block brackets have the advantage of requiring much less concrete. In addition, the sliding process for installing or erecting block brackets takes place continuously without any significant interruption during sliding up, as a function of the design of the sliding shuttering means.

For erecting or installing individual, e.g. cubic block brackets, it is possible to provide on the corresponding sliding shuttering liner plates having the projection thickness of the block brackets and referred to hereinafter as bracket depth. By removing such liner plates and then inserting same above a bracket to be installed, it is possible to produce block brackets in the sliding process. However, this suffers from the serious disadvantage that the horizontal forces must be transferred to the corresponding concrete wall by means of the liner plates in the case of a reinforced concrete structure having an inclined axis. However, conventional blind shutterings are not suitable as liner plates for such force transfers. Known liner plates were also unsuitable for the possibly necessary circumferential positioning thereof.

The problem of the present invention is therefore to provide a sliding process and a sliding shuttering means suitable for this in such a way that in an economically and technically satisfactory manner it is possible to install block brackets individually or in groups, even in the case of annular and optionally conically tapering and/or sloping structures.

An important inventive principle is to provide the sliding shuttering on the intended projection side of the bracket on the structure wall with a shuttering form or box as an integral part of the sliding shuttering. This shuttering form which roughly in horizontal cross-section has a complementary and advantageously slightly larger form as compared with the corresponding block bracket is terminated or sealed with respect to the adjacent shuttering skin by a shuttering apron. This leads in horizontal section to a continuous shuttering skin engaging on the corresponding outer or inner face of the structure wall.

The integration of the shuttering form for the particular block bracket with the actual shuttering skin of the sliding shuttering can be realized in that prior to the erection of the inner and outer sliding shuttering, the shuttering form is integrated at the lowest level of the structure and is present in jointly sliding manner over the entire height of the structure. Particularly in the case of a sliding shuttering skin in the form of a lamellar shuttering, it is also possible to introduce the shuttering form with shuttering apron circumferentially into the lamellar shuttering just below the lowest level of the block bracket and at the predetermined location of the block bracket to be installed to remove the shuttering apron aligned with the adjacent sliding shuttering in the circumferential or sloping direction of the structure wall.

In the case of integrated, jointly sliding shuttering form in the sliding shuttering on reaching the lowest level of a block bracket to be installed, on the wall side the shuttering form is removed by removing the shuttering apron, which is in particular held relative to the upwardly sliding shuttering skin. Accompanied by the concreting of the corresponding block bracket, the complete sliding shuttering is raised and a shuttering apron is used on the wall side for the aligned termination of the shuttering form, so that the lower edge of the shuttering apron defines the top level of the block bracket or the bearing surface of the latter. On reaching this position the shuttering apron is fixed with the remaining sliding shuttering and also slid upwards.

Corresponding shuttering forms for block brackets can be integrated into the outer sliding shuttering and alternatively or additively in the inner sliding shuttering. The shuttering form essentially forms a negative form of the bracket to be constructed, the spacing between the side faces of the shuttering form being somewhat larger than the width of the corresponding bracket. This makes it possible to define the side faces of the bracket by the side face shutterings inserted in the shuttering form. These side face shutterings are advantageously arranged in a stationary, fixed manner with respect to the structure, whereas the end face of the bracket is formed by the corresponding shuttering skin of the sliding shuttering or by a shuttering face sliding therewith. The side face shutterings are appropriately wooden shutterings, which are connected to a bottom shuttering defining the lower face of the bracket for stationary arrangement purposes. For fixing to the structure, the bottom shuttering is advantageously suspended on at least two reinforcing iron members projecting from the structure, such as steel angle sections. The latter can e.g. be welded to the reinforcing bars of the structure wall or can be an integrated part of the wall reinforcement. The reinforcing bars or steel angle sections of the bracket only project within the bracket and are completely enveloped when concrete is introduced.

The introduction of side face shutterings within the shuttering form has the advantage that the fresh concrete of the brackets is kept free during its hardening from forces exerted in the sliding shuttering, e.g. in the circumferential direction. The side face shutterings constructed as stationary shutterings provide an adequate air separation, e.g. to the steel surfaces of the lamellar shutterings of the shuttering forms and can consequently be much more easily deshuttered. The positive allowance of the shuttering forms compared with the final dimensions of the bracket, particularly in the circumferential direction and depth, ensures that the desired dimensions of the bracket are precisely adhered to through corresponding adaptation of the side face shutterings used.

In order to permit an automatic and/or forcibly guided shifting of individual lamellar shuttering elements in the circumferential direction, the lamellar shuttering of a shuttering skin comprises per shuttering field one or two starting plates and a plurality of interposed lamellar intermediate plates or shims. The starting plates e.g. have three to four times the width of the intermediate plates, which can e.g. be 25 cm wide. The starting plates preferably comprise a relatively thin spring steel and are connected in stationary manner to a pile over one or two pile spacings.

In the case of a diameter change, particularly a diameter decrease of the e.g. annular structure, the intermediate plates suspended on form or guide pipes by reducing the distance along the arc between the piles can move behind the corresponding starting plate. In the case of a complete overlap of an intermediate plate by the wall-side starting plate, the corresponding intermediate plate can be removed e.g. vertically upwards or downwards out of the sliding shuttering. In the insertion position of the starting plates, they are at least slightly pretensioned with respect to the intermediate plates and pass into the latter with flat-terminating vertical edge region. In the same way as the intermediate plates, the starting plates can be carried circumferentially in stationary manner with the corresponding pile and in addition can optionally be released from the sliding shuttering. As a result of the abutment of the vertical edges of the intermediate plates and the sloping transition at the starting plates, a substantially smooth and continuous shuttering skin is obtained.

A diameter change of the sliding shuttering in the case of annular structures is preferably carried out in the areas outside the shuttering forms for the corresponding block brackets. This is particularly appropriate where the distance along the arc between the individual brackets is relatively small, so that the intermediate spacing between the brackets is not adequate for the insertion of starting plates and/or intermediate plates.

The sliding shuttering means with a group of adjacent shuttering forms for a corresponding number of individual block brackets can e.g. be used with particular advantage in the erection of large chimneys, which have an upward conical taper. The block brackets are required in connection with such chimneys for supporting the steel or reinforced concrete platforms prefabricated in the interior of the chimney in the bottom region and which in turn carry smoke tubes or are at least intended for the guidance thereof.

In the case of the conventional erection of a group of block brackets at different height levels, in the inner surface of the concrete wall the individual block brackets at different height levels in the case of a chimney mantle bent in a plane are located in a straight line of the circumferential surface, which would intersect the chimney axis in its extension. In the ground plan projection these block brackets for the different height levels are provided on the corresponding radius of the ground plan circle, said radius always being at the same angle to the radii of the adjacent block brackets. However, this means that the arc segment spacing between adjacent block brackets in the case of an upwardly tapering chimney changes and in particular decreases as a function of the corresponding horizontal plane in which the brackets are arranged, whereas the arc angle for the corresponding brackets remains constant.

In this configuration, in which the block brackets of different height levels move on the same radius, the shuttering regions between the individual shuttering forms are preferably also lamellar and can undergo size increases or decreass in the circumferential direction.

In practice, the platforms to be mounted on the block brackets within a chimney are produced by the same shuttering within the chimney at bottom level. The bearing axes of these platforms do not run radially and instead pass e.g. parallel to a major axis of a horizontal plane, e.g. parallel to the 90°–270° axis. With this configuration of the bearing axes of the platforms, said axes are congruent in ground plan in all the horizontal planes. This means that the arc segment spacing between the associated block brackets of a group remains substantially constant, whereas the angle of the arc changes in different horizontal planes. Thus, the individual block brackets in the imaginary projection of the chimney circumferential surface move in a plane along lines not intersecting the extension of the chimney axis and which instead run pairwise and in parallel, but with an inclination corresponding to that of the circumferential surface. The movement line for adjacent block brackets over the entire height of a chimney is consequently formed by constantly spaced parallel lines in the ground plan projection.

With regards to the platforms to be mounted on the block brackets, they obviously have external dimensions which are smaller than the smallest internal spacing between facing block brackets and solely the bearing axes must be adapted to the diameter change of a conically upwardly tapering structure.

In order to simplify the sliding shuttering in the case of conically tapering structures, the shuttering forms provided for the individual block brackets are kept constant with regards to their spacing between the side faces and their depth. In the same way a substantially constant arc segment spacing is maintained between the shuttering forms of a group of block brackets, so that diameter changes to the sliding shuttering in the sliding shuttering area located outside the group of shuttering forms is evened out by the sliding of intermediate plates behind the starting plates.

As it is necessary to circumferentially compensate distances of e.g. 2 to 4 m for guiding the block brackets on parallel lines in the case of conically tapering structures, the associated shuttering forms of the block brackets are advantageously forcibly guided with a displacing and adapting means. This can be based on tension or compression for both stationary blocking and for circumferential displacement. This displacing means simultaneously serves to improve the adaptation to the corresponding bending or curvature, particularly as there is to be no change to the arc segment spacing of an associated group of shuttering forms. The displacement means is appropriately designed for tension for better material dimensioning and is articulated non-positively to adjacent piles.

In the case of the sliding shuttering means with shuttering forms with a constant arc segment spacing, the erected or installed block brackets with different horizontal planes move on parallel lines in ground plan, the relative position with respect to the sliding shuttering located outside this region constantly changing.

In order to permit continuous bending between the field of several associated shuttering forms for block brackets and the adjacent lamellar shuttering skin of the sliding shuttering, there are overlapping regions of the form and guide pipes of the shuttering skin with the guide pipes or rails of the sliding shuttering region of the shuttering forms. The overlap region extends over one to two pile fields.

In this way, the invention makes it possible to produce block brackets with the most varied horizontal cross-sections, such as triangles, rectangles, trapeziums, arcs, etc. when installing block brackets by means of the inventive sliding shuttering means, apart from an automatic adaptation of a lamellar shuttering to different diameters, there can also be a planned movement of a particular arc segment in the circumferential direction whilst retaining the corresponding arc segment length, whilst initiating diameter changes in other sliding shuttering regions.

The main advantage of this sliding shuttering means compared with known sliding shuttering systems are on the one hand the monolithic, notch-free construction of the brackets, whereby the bracket height can be adapted to the static requirements. On the other hand this sliding shuttering means makes it possible to continuously and simultaneously erect the block brackets with the structure wall. Particularly in the case of sloping structures, it is important that the horizontal forces introduced into the concrete wall do not load blind shuttering or lining elements and instead act on the smooth main surface of the shuttering skin. On introducing the shuttering apron for terminating the wall-side region of the shuttering form no wall thickness matching is generally required, because the shuttering apron is appropriately made from a thin spring steel sheet in the same way as the starting sheets or plates. However, particularly in the case of wider block brackets, it is appropriate to construct the shuttering apron by means of several consecutive, abutting intermediate plates in the form of sheet steel strips. As soon as the shuttering aprons are at the same level as the sliding shuttering through the raising of the latter, they can be fixed thereto and raised to the next higher bracket plane as part of the sliding shuttering. This gives smooth wall surfaces differing in no way from the surrounding wall surfaces of the structure.

The invention is described in greater detail hereinafter relative to a diagrammatic embodiment and the attached drawings, wherein show:

FIG. 1 A detail from essential parts of a sliding shuttering means in vertical section for the erection of a structure with a roughly vertical wall, with a block bracket set up at a low level.

Figure 2:
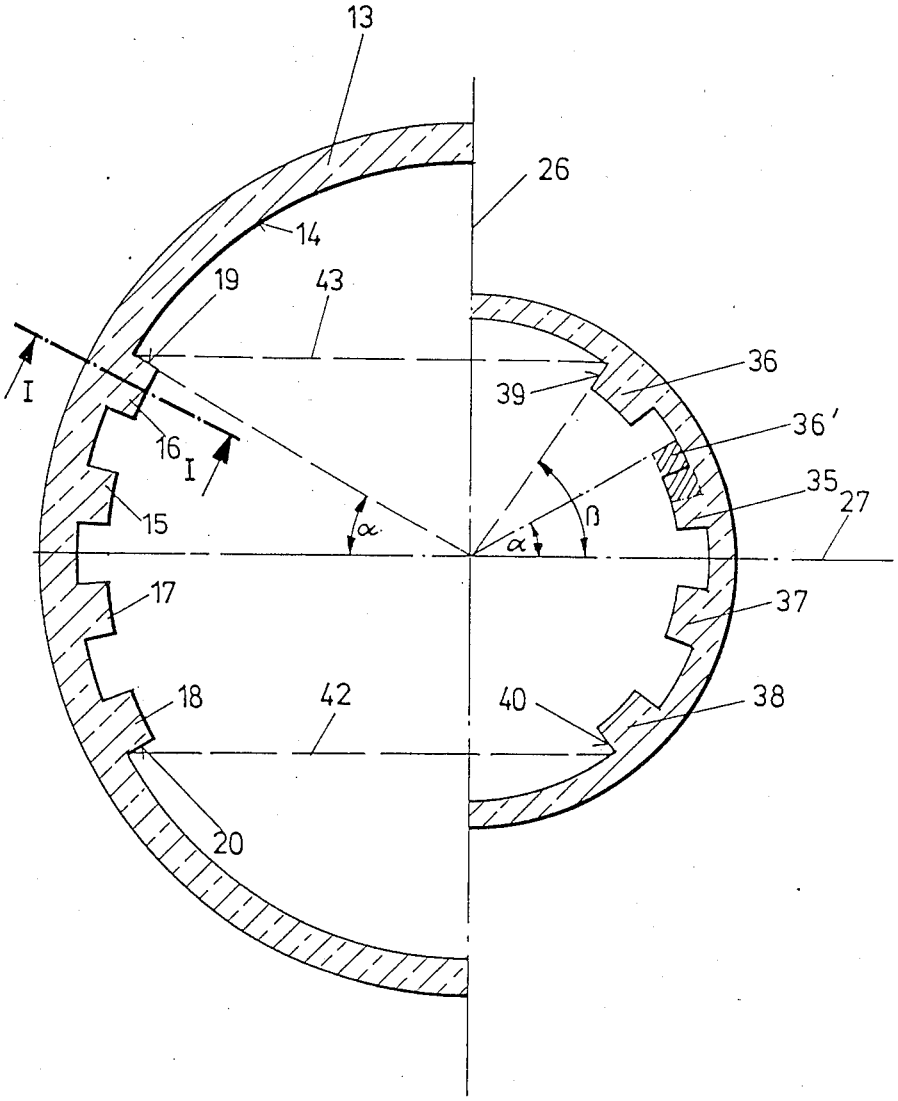

FIG. 2 Two horizontal sections provided in mirror symmetric manner to a central axis through a structure having a conical upward taper, a group of four adjacent block brackets being produced in constant arc segment spacing, being represented in the left-hand half of the section on a low level and in the right-hand half thereof on a higher level of the structure.

Figure 3:
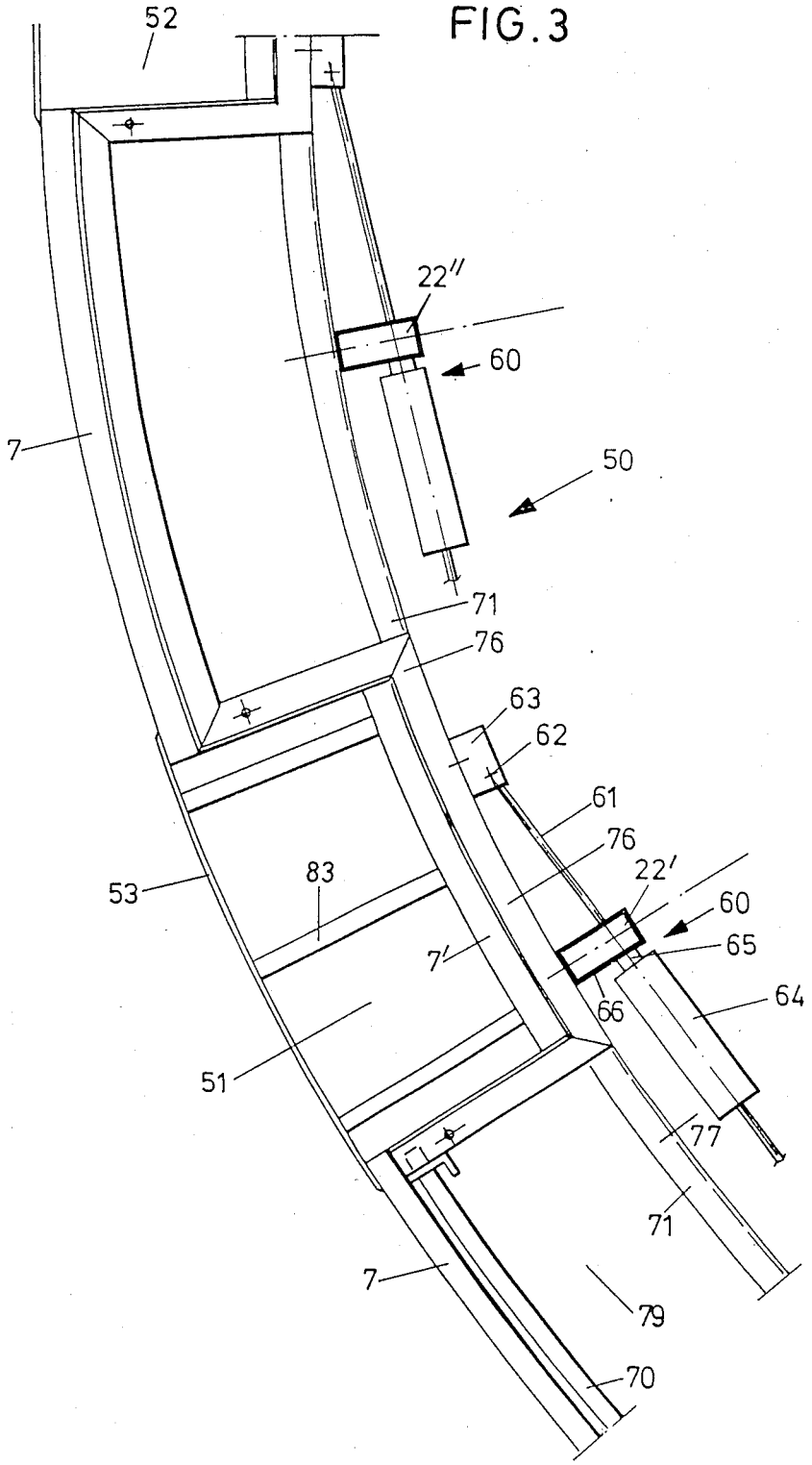

FIG. 3 An arc detail from a sliding shuttering with shuttering forms for block brackets in horizontal section, the shuttering forms being closed by shuttering aprons.

Figure 4:
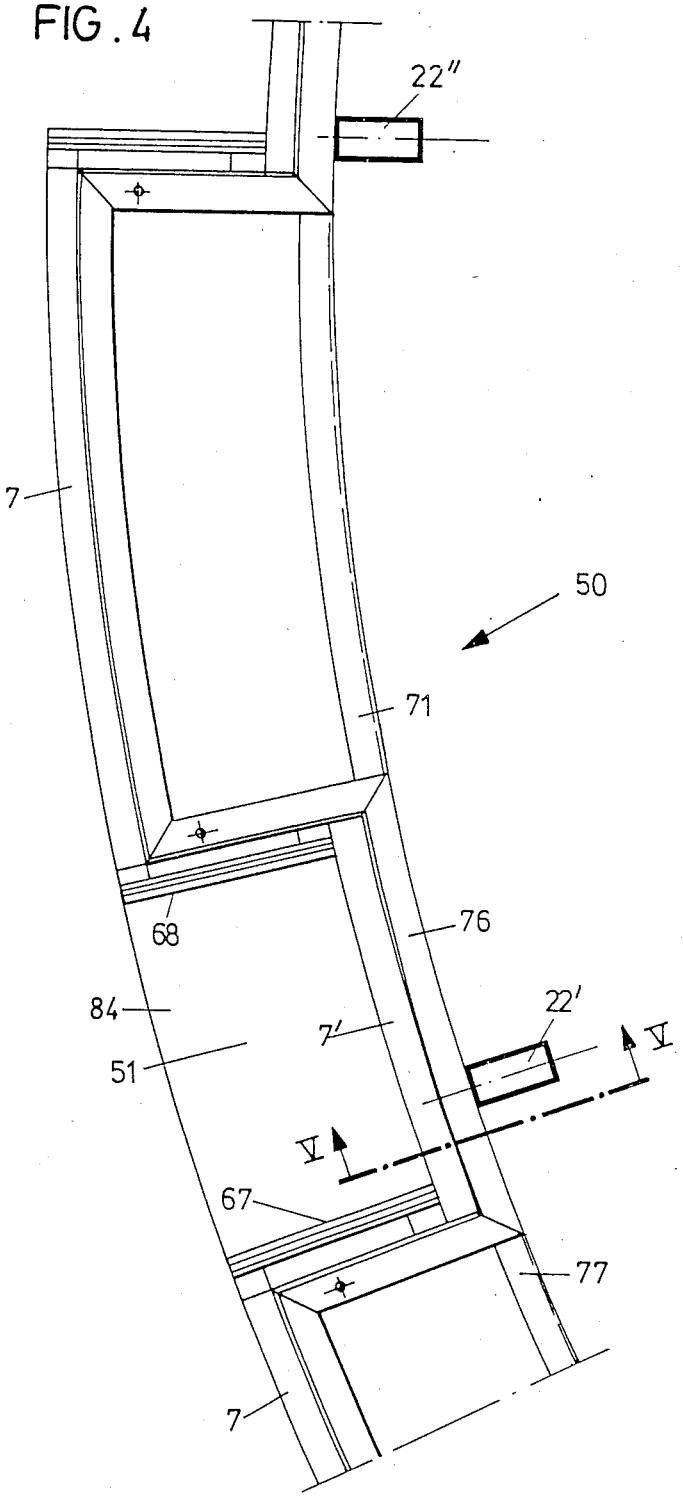

FIG. 4 A simplified representation of FIG. 3 with the shuttering aprons removed and side face shutterings inserted in the shuttering form.

Figure 5:
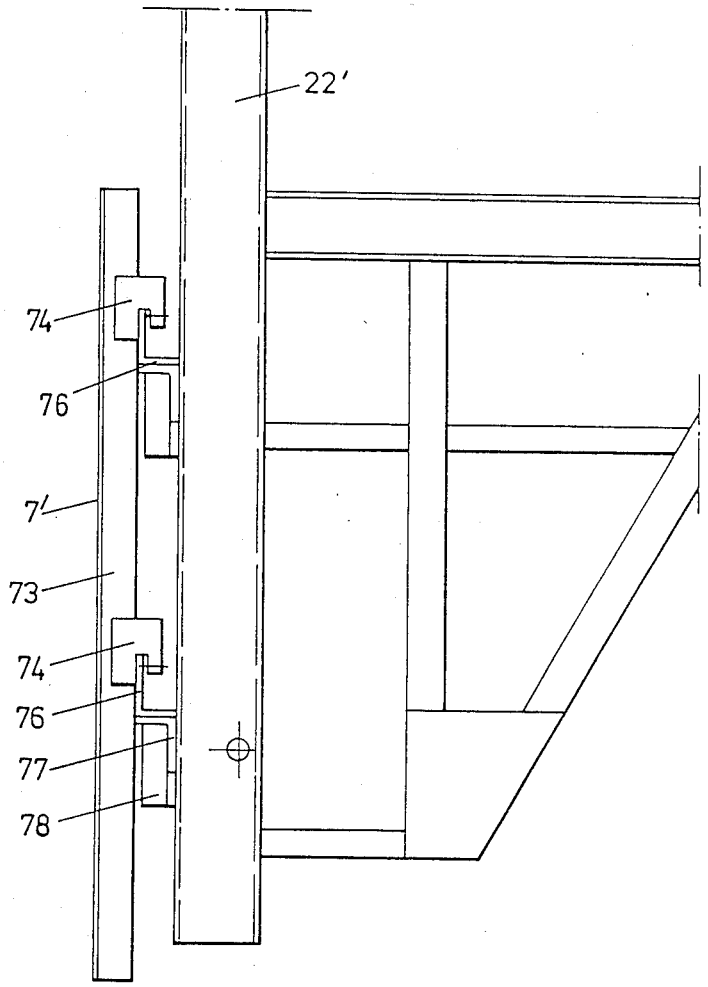

FIG. 5 A vertical section through the sliding shuttering means in the vicinity of section line V—V of FIG. 4.

Figure 6:
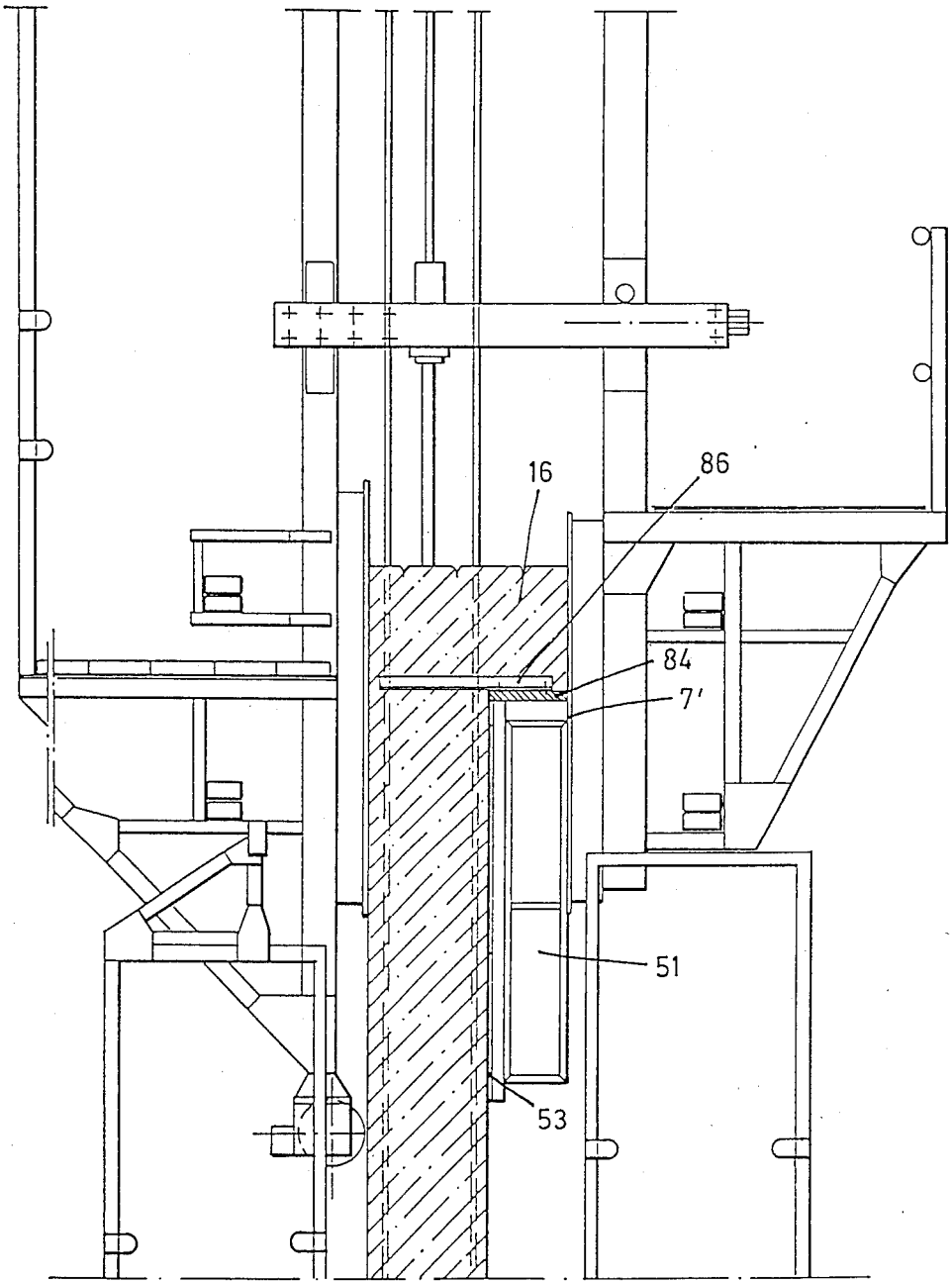
Figure 7:
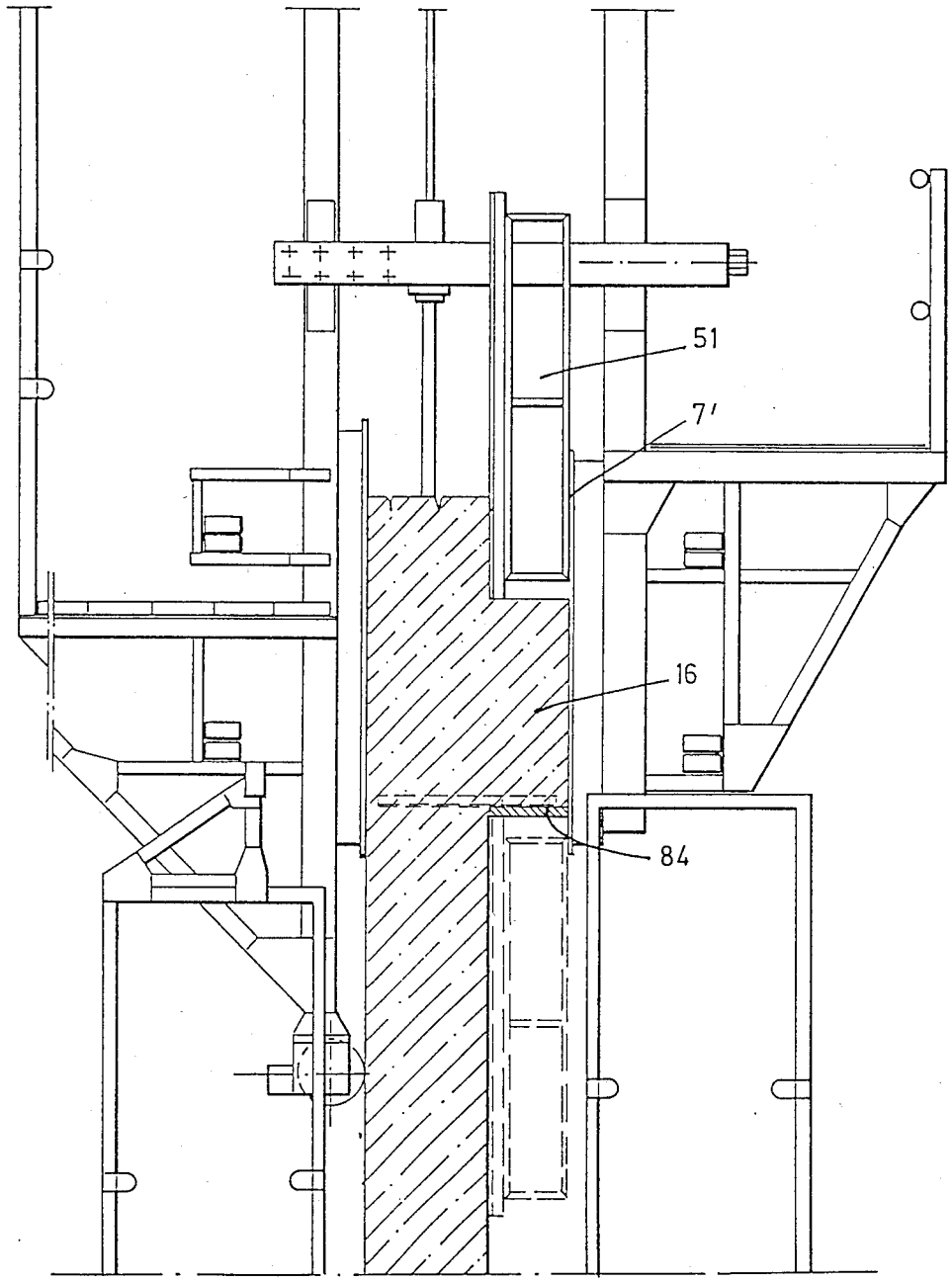

FIGS. 6 and 7 are views similar to FIG. 1 illustrating the sliding shuttering means as used in forming a block bracket.

FIG. 1 diagrammatically shows in the form of a partial detail a sliding shuttering means 1 on a structure wall 13 erected substantially vertically in the sliding process. The sliding shuttering means 1 has a plurality of outer piles 21 and inner piles 22, normally supported at their lower ends by means of supporting rollers 29 against the hardened concrete wall. There are no supporting rollers 29 in the case of inner piles 22 in the vicinity of the block brackets to be formed, because they would be ineffective due to the distance between the pile and the concrete wall. When erecting an annular structure, said piles 21, 22 are continued upwards in not shown manner. The upper ends are in force of non-positive engagement with a girder grillage which horizontally spans the structure over its diameter. Piles 21, 22 are non-positively interconnected by means of two cross-members, whereof the lower one is shown as pile support 23 and are adjustable with respect to their spacing, e.g. by means of traverse spindles 54.

The pile structure comprising piles 21, 22 and the corresponding cross-members is non-positively engaged by means of a lifting device 34 with a climbing bar 33, which is concreted into concrete wall 13 and is used for sliding up the complete sliding shuttering means.

Towards the wall side, piles 21, 22 have the corresponding sliding shuttering 4, 5. Sliding shuttering 4 has a lamellar shuttering skin 6 oriented towards the concrete wall, whilst a shuttering skin 7 is provided on the opposite side for forming inner surface 14. The lamellar shuttering skin is guided in supporting manner on the pile structure, circumferential displacement being possible as a result of diameter changes of the structure.

In FIG. 1, working platforms 31 are provided in different planes on either side of the structure wall and can be rigidly connected in articulated manner to the pile structure.

Below shuttering 7 a block bracket 16 is shown on the inside of structure wall 13 in the manner in which they can be constructed in monolitically integrated manner with the structure wall within the scope of the sliding process.

A special problem when designing the sliding shuttering means 1 for conically tapering and/or additionally sloping structures occurs where the block brackets 15 or 16 to be installed are required in groups and the arc segment spacing between the brackets and over the entire extension of the group must be at least substantially constant in all horizontal planes of the structure.

In FIG. 2 a circular structure is provided in mirror symmetrical manner to the axis 26 of the horizontal section at a height level with a greater diameter in the left-hand part area and at a height level with a smaller diameter in the right-hand area.

In the left-hand half, a block bracket 16 projecting roughly rectangularly out of the concrete wall 13 is installed at an arc angle $\alpha$ to transverse axis 27. In the case of the normally expected diameter reduction of a sliding shuttering means, the block bracket 16 or the block bracket mirror symmetrical thereto and facing axis 26 would move inwards towards axis 27 on the corresponding radius with arc angle $\alpha$.

Bearing in mind the bearing axes 42, 43 for the platforms formed in the structure and to be mounted on the brackets and which run e.g. parallel to transverse axis 27, the special feature arises that the group of block brackets 15 to 18 are to retain the same arc segment spacing on a height or horizontal plane of the structure with a smaller internal diameter. This means that the block bracket 16 in the left-hand half does not appear at a higher level under the same arc angle $\alpha$ as the hatched block bracket 36' and instead the homologous counterpart to block bracket 16 is the block bracket 36 arranged at the angle $\beta$ to transverse axis 27.

The arc segment spacing between the individual block brackets 15 or 16 or the complete arc spacing between the outer side faces 19, 20 of block brackets 16 or 18 or the outer side faces 39, 40 of block brackets 36, 38 therefore remains constant over the entire height of the structure, so that the sliding shuttering means circumference is reduced in this case outside the group of block brackets by an overlapping movement of the intermediate plates behind the corresponding starting plates.

As a result of brackets 15 to 18 or 35 to 38 to be produced in the present embodiment in mirror symmetrical manner to axis 26, it is possible to provide inner platforms with the same orientation of the bearing axes over the entire structure height.

FIG. 3 shows in a vertical view from above an arc segment detail of an inner sliding shuttering 50, in which a shuttering forms 51, 52 which are approximately rectangular in horizontal section are terminated by a wall-side covering means in the form of a shuttering apron 53. The inner shuttering skin 7, which comprises individual lamellar intermediate plates, which abut for forming a smooth shuttering surface, has for the purpose of installing roughly complimentary block brackets to the shuttering form 51, an approximately rectangular shuttering box, which is an integral part of the corresponding shuttering skin and sliding shuttering. As a function of the distance between the side faces of shuttering form 51, the shuttering apron 53 also assumes the bending contour of the adjacent shuttering skin. The supporting elements, also in the vicinity of the shuttering forms are piles 22' and 22''.

It can be gathered from FIGS. 4 and 5, that the individual shuttering forms 51 are non-positively connected to pile 22' on the wall-remote side by means of hook members 74 releasable from the vertical stiffening webs 73 of the shuttering skin 7', so that the latter including shuttering form 51 and shuttering apron 53 is carried suspended on the corresponding pile 22'.

Stiffening elements, e.g. L-shaped angular rails on the wall-remote side define the shuttering form for horizontal force transfer and for force transfer in the circumferential direction of the sliding shuttering. Thus, whilst ignoring the bending, the inner shuttering skin 7 has roughly box-like offsets, which are roughly adapted to the outer contour of the block brackets to be installed.

The L-shaped angular rail 76 is placed flat on an angular rail connected in inverted manner with the pile via a supporting member 78. This fixing of the shuttering skin 7, 7' or shuttering form 51 to pile 22' permits both a radial adjustment of the shuttering skin and a displacement of the shuttering skin 7, including shuttering forms 51 in the circumferential direction, which is made possible through the relative displacement between hook member 74 and angular rail 76 or between angular rail combination 76, 77 and supporting member 78.

The inner sliding shuttering 50 has primary form pipes 70, on which in particular the intermediate plates of the lamellar shuttering are automatically circumferentially displaceable in the case of a diameter change. In the vicinity of shuttering forms 51, the sliding shuttering 50 has an inner, secondary guide rail 77 or form pipe 71 used for horizontal guidance purposes and for bending the shuttering skin in the vicinity of shuttering form 51. The primary and secondary form pipes 70 or 71 overlap in the adjoining region 79 over one to two pile fields, so that continuous bending is ensured.

Shuttering apron 53 is engaged on the adjacent shuttering skin 7 preferably from above. During the concreting of a block bracket, the shuttering apron 53 is kept stationary with its lower horizontal edge on the upper level of the bracket, so that the other sliding shuttering is slowly guided upwards. Only in the case of further upward sliding of the sliding shuttering over and beyond the block bracket is the shuttering apron 53 detachably secured to the adjacent sliding shuttering arrested and carried along. By means of tensioning devices, the shuttering apron 53 is pretensioned radially and/or by means of transverse members 83, which are supported against the sliding shuttering, is pretensioned radially inwards under tensile stress.

In order to bring about a circumferential displacement, whilst simultaneously maintaining the arc segment spacing in the group of shuttering forms, displacement means 60 are provided, which are non-positively connected to piles 22' and 22''. On the wall-remote side of the shuttering skin, e.g. on stiffening webs, displacement means 60 engages on a bearing block 63 fixed thereto, which is e.g. a U-shaped section iron. A tension member or rod 61, which is passed through a bore in pile 22', engages in articulated manner by means of a roughly vertically directed pivot bearing 62 on bearing block 63. On the face 66 of pile 22 remote from bearing block 63 is supported a frontally rounded plunger 65, which can e.g. be pressurized in the direction of tension member 61 by means of a hydraulic jack 64. It is possible to use a press or a spindle in place of the jack.

Although it is possible to pressurize the displacement means 60, it is preferable to place it under tension. By acting on plunger 65, bearing block 63 and the shuttering skin nonpositively connected thereto can be moved towards the corresponding pile 22', so that synchronously matched with the further displacement means 60, it is possible to bring about a horizontal displacement of the region of the shuttering forms without shortening the arc segment.

FIG. 4 is a simplified representation of the part detail of FIG. 3 with the shuttering apron 53 removed, so that there is an open shuttering form 51 for concreting the corresponding block bracket. In the example of FIGS. 3 and 4, the concrete wall is cast to the left of the shuttering skin. Before removing the shuttering apron 53, a side face shuttering 67 or 68, e.g. a wooden shuttering is applied to the radially directed side faces of shuttering form 51. These side face shutterings are fixed on the underside with a corresponding slope for the underside of the block bracket to be installed by a bottom shuttering 84. In the present case the bottom shuttering 84 and the two side face shutterings 67, 68 remain stationary with the structure wall on sliding up the shuttering skin 7, whilst the end face of the block bracket directed towards the centre of the structure is formed by a shuttering skin 7' carried along with the sliding shuttering.

We claim:

1. Sliding shuttering device for producing a reinforced concrete structure wall of annular horizontal cross section with integrally formed block brackets projecting from the structure wall, said sliding shuttering device comprising associated inner and outer piles adapted to extend substantially in a projection direction of the structure wall, an inner and an outer sliding shuttering arranged on the respective piles, pile cross members articulated to and connecting respective ones of said inner and outer piles, and a lifting device for continuously lifting said sliding shuttering device together with said piles, pile cross members, and said inner and outer sliding shuttering, wherein said sliding shuttering includes at least one integrated shuttering form means having a transverse cross-section substantially complementary to a transverse cross-section of a block bracket to be formed on the wall for forming said block bracket, the integrated shuttering form means having an open side channel facing the structure wall, a wall-side covering means received in said channel for covering said open side channel of the integrated shuttering form means in sliding regions wherein the structure wall is to be formed without a block bracket, said covering means being attachable in substantially aligned manner to the sliding shuttering adjacent the integrated shuttering form means in said sliding regions, and being detachable from the sliding shuttering for remaining stationary when the shuttering attains a level corresponding to an underside of said block bracket, a bottom shuttering means for fixing with respect to the structure wall when the shuttering attains the underside level of the block bracket to provide a lower surface to the shuttering form means for forming the underside of the block bracket, and wherein after said sliding shuttering has reached a top level of said block bracket, said covering means may again be attached to said sliding shuttering for covering said open side channel of said integrated shuttering form means.

2. Sliding shuttering device according to claim 1 wherein said shuttering form means includes side face shuttering for fixing with respect to the structure wall to form side faces of for the block bracket.

3. Sliding shuttering device according to claim 1 wherein the channel has a substantially constant transverse cross-section irrespective of diameter changes in the wall being formed during sliding movement of the shuttering.

4. Sliding shuttering device according to claim 1 for forming an annular structure with at least one group of circumferentially spaced, reciprocally associated block brackets whose spacing in circumferential direction is substantially constant, wherein displacement means are provided for forcibly displacing said sliding shuttering and the associated shuttering form means of the block brackets in circumferential direction.

5. Sliding shuttering device according to claim 4, wherein said inner and outer sliding shuttering is constructed as a laminar shuttering; said displacement means is connected with a group of shuttering form means for said block brackets and is articulated to said piles adjacent to said group of shuttering form means; and an overlapping means for absorbing circumferential changes of the sliding shuttering due to diameter changes of the structure is provided by overlapping displacement of the laminar shuttering outside said group of shuttering form means.

6. Sliding shuttering device according to claim 1, wherein a guidance means for diameter and curvature adaption is provided on a wall-remote side of the shuttering form means for the block brackets.

7. Sliding shuttering device according to claim 1 for forming an annular structure wall with different diameters and with at least one group of circumferentially spaced, reciprocally associated block brackets, whose spacing in the circumferential direction of the annular structure wall is substantially constant, wherein a blocking means is provided for keeping said sliding shuttering and the associated shuttering form means for said block brackets in stationary manner in the circumferential direction.

8. Sliding shuttering device according to claim 1, wherein said bottom shuttering means is fixed to a suspension means projecting from the structure wall.

9. Sliding shuttering device according to claim 8, wherein said suspension means comprises reinforcing steel members.

10. Sliding shuttering device according to claim 9, wherein said reinforcing steel members are welded to reinforcing bars of the structure wall.

11. Sliding shuttering device according to claim 9, wherein said reinforcing steel members are integrated parts of a wall reinforcement.

* * * * *